US011817613B2

(12) United States Patent
Fang

(10) Patent No.: US 11,817,613 B2
(45) Date of Patent: Nov. 14, 2023

(54) COUPLING COMPONENT, MICROWAVE DEVICE AND ELECTRONIC DEVICE

(71) Applicant: BOE TECHNOLOGY GROUP CO., LTD., Beijing (CN)

(72) Inventor: Jia Fang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 322 days.

(21) Appl. No.: 17/425,543

(22) PCT Filed: Feb. 27, 2020

(86) PCT No.: PCT/CN2020/076962

§ 371 (c)(1),
(2) Date: Jul. 23, 2021

(87) PCT Pub. No.: WO2021/168735

PCT Pub. Date: Sep. 2, 2021

(65) Prior Publication Data

US 2022/0320701 A1 Oct. 6, 2022

(51) Int. Cl.

| | |
|---|---|
| ***H01P 5/02*** | (2006.01) |
| ***H01P 1/18*** | (2006.01) |
| ***H01P 1/20*** | (2006.01) |

(52) U.S. Cl.

CPC ..... *H01P 5/028* (2013.01); *H01P 1/18* (2013.01); *H01P 1/20* (2013.01)

(58) Field of Classification Search

CPC .... H01P 5/028; H01P 1/18; H01P 1/20; H01P 3/085; H01P 1/047

See application file for complete search history.

(56) References Cited

U.S. PATENT DOCUMENTS 5,093,639 A * 3/1992 Franchi ..... H01P 5/028 333/24 R
6,023,210 A * 2/2000 Tulintseff ..... H01P 5/028 333/33

(Continued)

FOREIGN PATENT DOCUMENTS

CN 103380537 A 10/2013
CN 105493343 A 4/2016

(Continued)

OTHER PUBLICATIONS

International Search Report from PCT/CN2020/076962 dated Nov. 18, 2020.
Written Opinion from PCT/CN2020/076962 dated Nov. 18, 2020.

*Primary Examiner* — Seokjin Kim
(74) *Attorney, Agent, or Firm* — Calfee, Halter & Griswold LLP

(57) ABSTRACT

Embodiments of the present disclosure relate to a coupling component, a microwave device and an electronic device. The coupling component includes a first ground electrode, a first dielectric layer, a first transmission line, a second dielectric layer, a second ground electrode, a first substrate, a second transmission line, a second substrate and a third ground electrode which are sequentially stacked. Each of the first to third electrodes has a slot, and orthographic projections of the slots on the first dielectric layer overlap. An orthographic projection of a coupling end of the first transmission line on the first dielectric layer overlaps an orthographic projection of the slot of the second ground electrode on the first dielectric layer. An orthographic projection of a coupling end of the second transmission line on the first dielectric layer overlaps the orthographic projection of the slot of the second ground electrode.

20 Claims, 8 Drawing Sheets

(56) References Cited

U.S. PATENT DOCUMENTS

| | | | | |
|---|---|---|---|---|
| 6,535,090 | B1 | 3/2003 | Matsuzuka et al. | |
| 6,545,572 | B1 * | 4/2003 | Ohta | H01P 5/028 333/246 |
| 8,633,784 | B2 * | 1/2014 | Ihla | H01P 1/047 333/24 R |
| 9,397,381 | B2 * | 7/2016 | Kondou | H01P 5/00 |
| 9,819,067 | B2 | 11/2017 | Yang et al. | |
| 2013/0328646 | A1 | 12/2013 | Kondou et al. | |
| 2016/0351988 | A1 | 12/2016 | Yang et al. | |
| 2019/0190110 | A1 * | 6/2019 | Clark | H01P 5/028 |

FOREIGN PATENT DOCUMENTS

| | | | | | |
|---|---|---|---|---|---|
| CN | 110137636 | A | * | 8/2019 | G02F 1/1313 |
| GB | 2552836 | A | * | 2/2018 | H01P 3/081 |
| JP | 2001352206 | A | | 12/2001 | |
| JP | 2011223203 | A | | 11/2011 | |
| JP | 5566169 | B2 | | 8/2014 | |
| JP | 2017069837 | A | | 4/2017 | |
| JP | 6523124 | B2 | | 5/2019 | |
| WO | WO-2012108084 | A1 | * | 8/2012 | H01P 11/001 |

* cited by examiner

COUPLING COMPONENT, MICROWAVE DEVICE AND ELECTRONIC DEVICE

CROSS REFERENCE

This application is the 371 application of PCT Application No. PCT/CN2020/076962, filed Feb. 27, 2020, the entire contents of which are incorporated herein by reference.

TECHNICAL FIELD

The present disclosure relates to microwave technologies, and in particular, to a coupling component, a microwave device and an electronic device.

BACKGROUND

The development of microwave technology requires more and more integrated and miniaturized devices, and the emergence of multilayer circuit boards makes miniaturization possible. Therefore, the transmission between microwave circuits on different dielectric boards is particularly important. The transmission is usually realized by means of vertical metal vias. However, with the emergence of new types of dielectric plates, such as glass, the fragile characteristics of the glass determine that the method using vias is not the first choice for cost reduction. Therefore, it is important to realize energy transmission between different transmission lines through electromagnetic coupling. However, the coupling between the striplines is very difficult, resulting in a large transmission loss.

SUMMARY

Embodiments of the present disclosure provide a coupling component, a microwave device and an electronic device, which can reduce the transmission loss.

An embodiment of the present disclosure provides a coupling component, including a first ground electrode, a first dielectric layer, a first transmission line, a second dielectric layer, a second ground electrode, a first substrate, a second transmission line, a second substrate and a third ground electrode which are sequentially stacked;

wherein:

each of the first ground electrode, the second ground electrode, and the third ground electrode has a slot, and orthographic projections of the slots of the first ground electrode, the second ground electrode and the third ground electrode on the first dielectric layer overlap;

an orthographic projection of a coupling end of the first transmission line on the first dielectric layer overlaps an orthographic projection of the slot of the second ground electrode on the first dielectric layer; and an orthographic projection of a coupling end of the second transmission line on the first dielectric layer overlaps an orthographic projection of the slot of the second ground electrode on the first dielectric layer.

According to an embodiment of the present disclosure, a transitional transmission structure is provided in the slot of the second ground electrode, and a gap is provided between the transitional transmission structure and the second ground electrode.

According to an embodiment of the present disclosure, the orthographic projection of the coupling end of the first transmission line on the first dielectric layer overlaps an orthographic projection of the transitional transmission structure on the first dielectric layer; and the orthographic projection of the coupling end of the second transmission line on the first dielectric layer overlaps the orthographic projection of the transitional transmission structure on the first dielectric layer.

According to an embodiment of the present disclosure, both the first transmission line and the second transmission line extend in a first direction.

According to an embodiment of the present disclosure, each of gaps formed between two opposite sides of the transitional transmission structure in the first direction and the second ground electrode is not greater than 0.1 mm.

According to an embodiment of the present disclosure, the orthographic projection of the coupling end of the first transmission line on the first dielectric layer completely overlaps the orthographic projection of the slot of the second ground electrode on the first dielectric layer in the first direction; and the orthographic projection of the coupling end of the second transmission line on the first dielectric layer completely overlaps the orthographic projection of the slot of the second ground electrode on the first dielectric layer in the first direction.

According to an embodiment of the present disclosure, the orthographic projections of the slot of the first ground electrode, the slot of the second ground electrode, and the slot of the third ground electrode on the first dielectric layer completely overlap.

According to an embodiment of the present disclosure, the slot of the first ground electrode, the slot of the second ground electrode, the slot of the third ground electrode, and the transitional transmission structure have a same shape.

According to an embodiment of the present disclosure, the coupling component further includes a liquid crystal layer, and at least a part of the liquid crystal layer is located between the second transmission line and the second substrate.

According to an embodiment of the present disclosure, the first dielectric layer and the second dielectric layer are printed circuit substrates; and the first substrate and the second substrate are glass substrates.

According to an embodiment of the present disclosure, each of the first dielectric layer, the second dielectric layer, the first substrate, and the second substrate has a thickness of 0.1 mm to 10 mm.

According to an embodiment of the present disclosure, each of the first ground electrode, the second ground electrode, and the third ground electrode has a thickness of 0.1 μm to 100 μm.

An embodiment of the present disclosure provides a microwave device, including the coupling component described above.

According to an embodiment of the present disclosure, the microwave device is a phase shifter, an antenna or a filter.

An embodiment of the present disclosure provides an electronic device, including the microwave device described above.

According to an embodiment of the present disclosure, the electronic device is a transmitter, a receiver, an antenna system, or a display.

BRIEF DESCRIPTION OF THE DRAWINGS

The drawings, which constitute a part of the specification, are provided to facilitate understanding of embodiments of the present disclosure, and are used to explain the embodiments of the disclosure together with the specification, but do not constitute any limitations on the present disclosure. Detailed example embodiments are described with reference to the accompanying drawings, the above and other features and advantages will become more apparent to those skilled in the art.

LISTING OF MAIN REFERENCE NUMBERS

Figure 1:
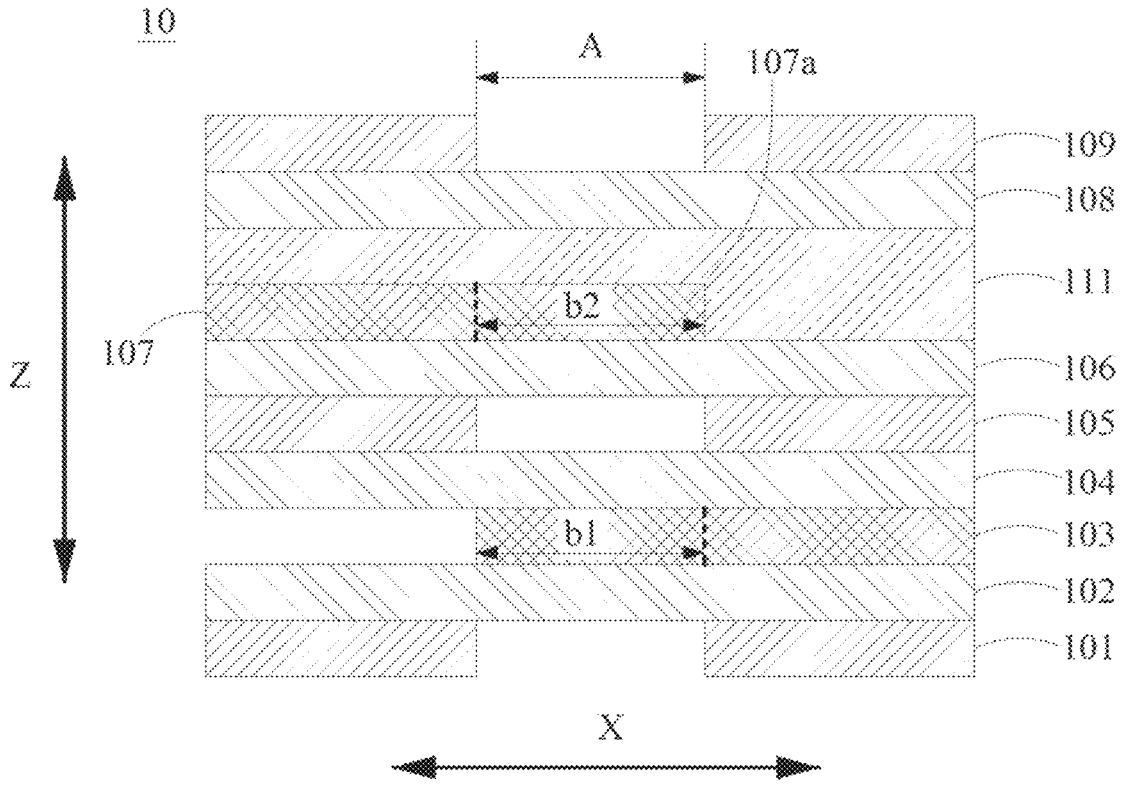
FIG. 1 is a cross-sectional view of a coupling component according to an embodiment of the present disclosure.

10: coupling component; 101: first ground electrode; 102: first dielectric layer; 103: first transmission line; 103*a*: coupling end; 104: second dielectric layer; 105: second ground electrode; 106: first substrate; 107: second transmission line; 107*a*: coupling end; 108: second substrate; 109: third ground electrode; 110: transitional transmission structure; 111: liquid crystal layer.

DETAILED DESCRIPTION

Example embodiments will now be described more fully with reference to the accompanying drawings. However, the example embodiments can be implemented in various manners, and should not be construed as being limited to the embodiments set forth herein; on the contrary, these embodiments are provided so that the present invention will be comprehensive and complete, and these embodiments are provided to fully convey the concepts of the example embodiments to those skilled in the art. The same reference numerals in the figures indicate the same or similar structures, and thus their repeated descriptions will be omitted.

Although relative terms such as "upper" and "lower" are used in this specification to describe relative relationships between one component in a figure and another component, these terms are used only for convenience, for example, these terms are based on the directions shown in the drawings. It can be understood that if a device shown in a figure is turned upside down, a component described as "upper" will become a "lower" component. When a structure is "on" another structure, it may mean that the structure is integrally formed on another structure, or that the structure is "directly" arranged on another structure, or that the structure is "indirectly" arranged on another structure through a further structure.

The terms "a", "an", "the", "said" and "at least one" are used to indicate the presence of one or more elements/components/etc.; the terms "include" and "have" are open terms and means inclusive, and refers to that in addition to the listed elements/components and so on, there may be other elements/components and so on.

With the development of radio frequency and microwave technologies, miniaturization has become an important development trend, which requires the integration of microwave circuits to be improved as much as possible. The microwave multilayer board technology is the key to solving this problem to realize the miniaturization, low cost and high performance of microwave circuits. However, the problem is that the routing of microwave lines is more complicated, and microwave signals need to be transmitted between different transmission lines. Metal can be used to shield signals to achieve isolation of signals in transmission lines of different layers.

In addition, when signals propagate between transmission lines of different layers, it is needed to introduce a suitable transition structure, which needs proper matching, so as to avoid the influence of signal reflection and excitation of high-order modes, so that the signals can be transmitted with minimal losses to transmission lines of another layer. Therefore, it is particularly critical to study the transition structure between transmission lines.

Generally, there are two transition structures between transmission lines. One is a vertical metal via hole. A hole is made on a dielectric substrate and, the via hole is metalized, so as to realize interlinks between signals. This structure is equivalent to realizing physical connection of transmission lines of different layers. By optimizing the size, a smaller transmission loss can be obtained, but the process requirements are high. The other one is electromagnetic coupling. The transmission of energy between transmission lines in different layers is achieved through microwave spatial coupling. Electromagnetic coupling has low requirements for processes, but the coupling between transmission lines in different layers usually causes greater transmission loss.

For microwave devices on glass substrates, such as phase shifters, antennas, filters, and so on, due to the immature glass perforation technology and the fragile nature of glass, the metal via hole is not suitable for energy transmission between transmission lines in different layers.

In order to solve the above problem, as shown in FIG. 1, an embodiment of the present disclosure provides a coupling component 10, which is based on electromagnetic coupling. The coupling component 10 includes at least a first ground electrode 101, a dielectric layer 102, a first transmission line 103, a second dielectric layer 104, a second ground electrode 105, a first substrate 106, a second transmission line 107, a second substrate 108, and a third ground electrode 109 which are sequentially stacked. It should be noted that the first ground electrode 101, the first dielectric layer 102, the first transmission line 103, the second dielectric layer 104, the second ground electrode 105, the first substrate 106, the second transmission line 107, the second substrate 108, and the three ground electrode 109 are sequentially stacked in the thickness direction Z of the coupling component 10.

For example, each of the first ground electrode 101, the second ground electrode 105, and the third ground electrode 109 may have a thickness of 0.1 μm to 100 μm, but is not limited to this. For example, each of the first ground electrode 101, the second ground electrode 105 and the third ground electrode 109 may have a thickness of 18 μm or 35 μm. In this embodiment, by designing the thickness of each ground electrode to be greater than or equal to 0.1 μm, on the one hand, the processing difficulty and cost can be reduced; and, on the other hand, the shielding performance of each ground electrode can be guaranteed. By designing the thickness of each ground electrode to be less than or equal to 100 μm, the too large ground electrode thickness and thus over thick coupling component 10 can be avoided, that is, the coupling component 10 can be easily made lighter, thinner and smaller, and thus the scope of application of the coupling component 10 can be expanded. However, the present disclosure is not limited to this, and the thickness of each substrate can also be within other numerical ranges, depending on specific requirements.

The thickness of each of the first dielectric layer 102, the second dielectric layer 104, the first substrate 106, and the second substrate 108 may be 0.1 mm to 10 mm. In this embodiment, by designing the thickness of each substrate to be greater than or equal to 0.1 mm, on the one hand, the processing difficulty and cost can be reduced; and, on the other hand, the support strength of each substrate can be guaranteed. By designing the thickness of each substrate to be less than or equal to 10 mm, a situation where the thickness of each substrate is too large and thus the coupling component 10 is too thick can be avoided, in other words, it is convenient for realize the lighter, thinner and miniaturized coupling component 10, and thus the applicable range of the coupling component 10 can be expanded. However, the present disclosure is not limited to this, and the thickness of each substrate can also be within other numerical ranges, depending on specific requirements.

The first ground electrode 101, the first dielectric layer 102, the first transmission line 103, the second dielectric layer 104, and the second ground electrode 105 shown in FIG. 1 can be formed as a stripline (the stripline can be defined as a first stripline); the second ground electrode 105, the first substrate 106, the second transmission line 107, the second substrate 108 and the third ground electrode 109 can be formed as another stripline (this stripline can be defined as a second stripline). That is, the coupling component 10 of according to embodiments of the present disclosure can be a stripline coupling component, which includes at least two striplines, and the two striplines share a ground electrode (i.e., the second ground electrode 105).

It should be understood that for the three layers of ground electrodes in the coupling component 10 according to some embodiments: the first ground electrode 101, the second ground electrode 105, and the third ground electrode 109, each layer can be used as a shielding structure. In terms of signal transmission, the coupling component 10 according to embodiments is not limited to the two-layer stripline shown in FIG. 1, and transmission structures (not shown in the figure) can also be provided below the first ground electrode 101 or above the third ground electrode 109. Therefore, the first ground electrode 101 can shield the first transmission line 103 from the interference signal under the first ground electrode 101, the second ground electrode 105 can shield the first transmission line 103 from the second transmission line 107, and the third ground electrode 109 can shield the second transmission line 107 from the interference signal above the third ground electrode 109.

Since the coupling between the first transmission line 103 and the second transmission line 107 is to be realized in embodiments of the present disclosure, each of the first ground electrode 101, the second ground electrode 105, and the third ground electrode 109 has a slot (the slot penetrates a corresponding ground electrode in the thickness direction Z), and the orthographic projections of the slots of the three ground electrodes on the first dielectric layer 102 overlap. The orthographic projection of a coupling end 103*a* of the first transmission line 103 on the first dielectric layer 102 overlaps the orthographic projection of the slot of the second ground electrode 105 on the first dielectric layer 102. The orthographic projection of a coupling end 107*a* of the second transmission line 107 on the first dielectric layer 102 overlaps the orthographic projection of the slot of the second ground electrode 105 on the first dielectric layer 102. This makes the energy transmission along the first transmission line 103 (second transmission line 107) form a break, so that energy can be transferred to the second transmission line 107 (first transmission line 103) through radiation coupling.

It should be understood that, in order to improve the coupling efficiency between transmission lines of different layers, the coupling end 103*a* of the first transmission line 103 and the coupling end 107*a* of the second transmission line 107 in embodiments of the present disclosure should be disconnected, that is, the coupling end 103*a* of the first transmission line 103 and the coupling end 107*a* of the second transmission line 107 should not be connected with other conductive structures in the same layers, so as to reduce the energy transfer between the same layers, and accordingly, more energy is transmitted through radiation coupling to the transmission structures in different layers via the slot in the first ground electrode 101, the slot in the second ground electrode 105 or the slot in the third ground electrode 109.

Figure 2:
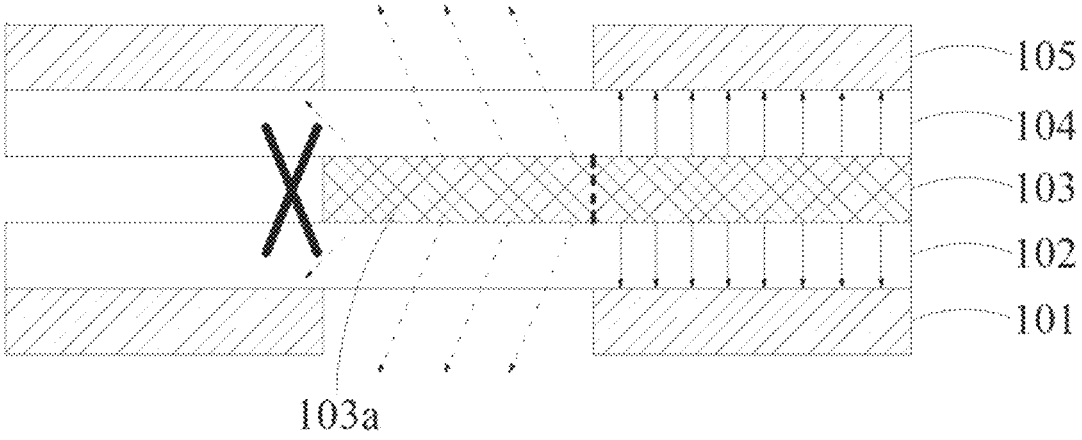
FIG. 2 is a schematic diagram showing energy transmission of a first stripline of a coupling component according to an embodiment of the present disclosure.

Taking the first stripline as an example, when signals are normally transmitted, the electric field distribution is as shown by the solid arrow in FIG. 2, and energy is transmitted along the first transmission line 103. When the first transmission line 103 is open (that is, its coupling end 103*a* is disconnected), the first ground electrode 101 is open (that is, the first ground electrode 101 has a slot corresponding to the coupling end 103*a* of the first transmission line 103), and the second ground electrode 105 is open (that is, the second ground electrode 105 has a slot corresponding to the coupling end 103*a* of the first transmission line 103), such structure is equivalent to discontinuous energy transmission and energy transmission cannot move forward. Therefore, there will be energy radiation, as shown by the dashed arrow in FIG. 2, so as to couple with transmission structures in different layer.

It should be noted that the coupling end 103*a* of the first transmission line 103 in embodiments of the present disclosure is a part of the first transmission line 103, the orthographic projection of which on the first dielectric layer 102 overlaps the orthographic projection of the slot of the second ground electrode 105 on the first dielectric layer 102; the coupling end 107*a* of the second transmission 107 is a part of the second transmission line 107, the orthographic projection of which on the first dielectric layer 102 overlaps the orthographic projection of the slot of the second ground electrode 105 on the first dielectric layer 102. Specifically, the coupling ends are the parts in the first transmission line 103 and the second transmission line 107 that correspond to area Ain FIG. 1. The size of the coupling end 103*a* of the first transmission line 103 in the first direction X is b1, and the size of the coupling end 107*a* of the second transmission line 107 in the first direction X is b2.

In addition, it should be noted that, in order to realize the coupling between the first transmission line 103 and a transmission structure under the first ground electrode 101, the orthographic projection of the coupling end 103*a* of the first transmission line 103 on the first dielectric layer 102 can overlap the orthographic projection of the slot in the first ground electrode 101 on the first dielectric layer 102. Similarly, in order to realize the coupling between the second transmission line 107 and a transmission structure above the third ground electrode 109, the orthographic projection of the coupling end 103*a* of the first transmission line 103 on the first dielectric layer 102 can overlap the orthographic projection of the slot in the third ground electrode 101 on the first dielectric layer 102.

In order to ensure that the energy radiated by the first transmission line 103 to opposite sides in the thickness direction Z is substantially the same, the orthographic projection of the slot in the first ground electrode 101 on the first dielectric layer 102 may completely overlap the orthographic projection of the slot in the second ground electrode 105 on the first dielectric layer 102. That is, the slots of the first ground electrode 101 and the second ground electrode 105 are completely the same in size and shape, and the positions of the slots of the first ground electrode 101 and the second ground electrode 105 in the thickness direction Z are the same.

Similarly, in order to ensure that the energy radiated by the second transmission line 107 to opposite sides in the thickness direction Z is substantially the same, the orthographic projection of the slot in the second ground electrode 105 on the first dielectric layer 102 may completely overlap the orthographic projection of the slot in the third ground electrode 109 on the first dielectric layer 102. That is, the slots of the second ground electrode 105 and the third ground electrode 109 are completely the same in size and shape, and the positions of the slots of the second ground electrode 105 and the third ground electrode 109 in the thickness direction Z are the same.

In summary, according to embodiments of the present disclosure, the orthographic projections of the slot of the first ground electrode 101, the slot of the second ground electrode 105, and the slot of the third ground electrode 109 on the first dielectric layer 102 completely overlap. This design can make the energy radiated to both sides of the first transmission line 103 and the second transmission line 107 be basically the same, and can also reduce the processing cost, that is: the slot in the first ground electrode 101, the slot in the second ground electrode 105, and the slot in the third ground electrode 109 can be formed using the same mask. It should be noted that the positions of the first ground electrode 101, the second ground electrode 105, and the third ground electrode 109 corresponding to the area A shown in FIG. 1 are slots. The first ground electrode 101, the second ground electrode 105, and the third ground electrode 109 can be the same in size and shape.

Figure 5:
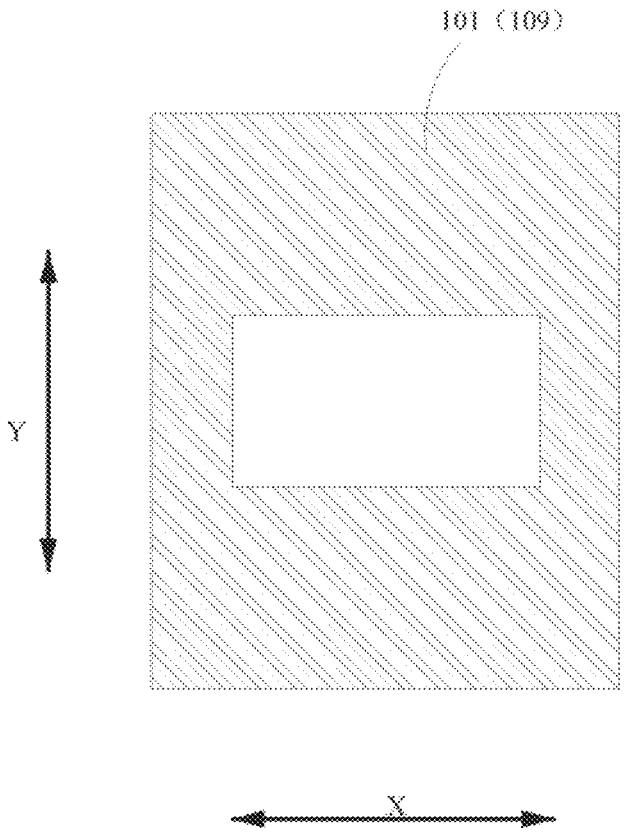
FIG. 5 is a schematic plan view of a first ground electrode or a third ground electrode in a coupling component according to an embodiment of the present disclosure.
Figure 6:
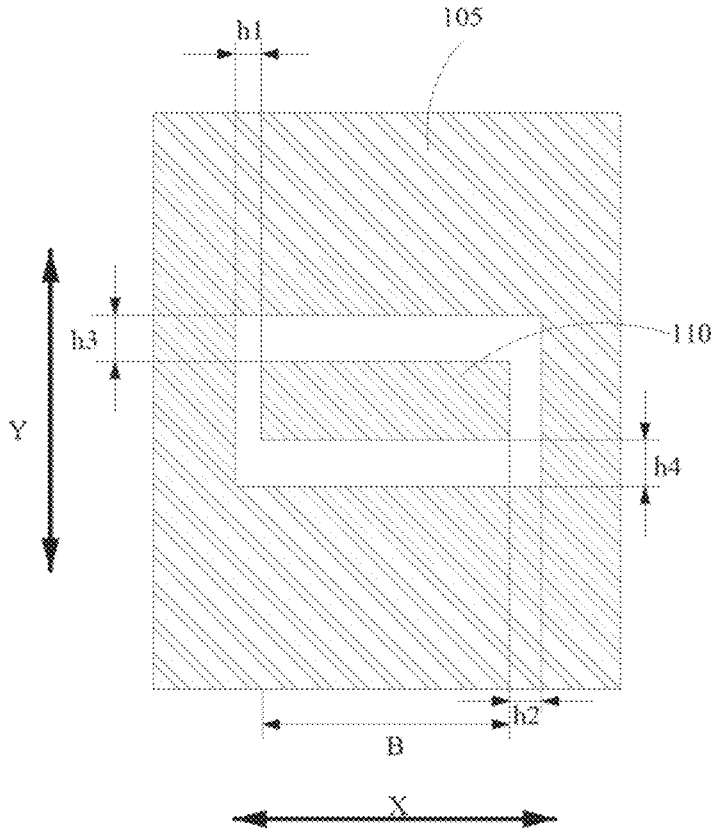
FIG. 6 is a schematic diagram showing a combination of a second ground electrode and a transitional transmission line in a coupling component according to an embodiment of the present disclosure.

According to some embodiments, the shapes of the slot in the first ground electrode 101, the slot in the second ground electrode 105, and the slot in the third ground electrode 109 are all round or rectangular (as shown in FIGS. 5 and 6), which may be convenient for processing; but the present disclosure is not limited to this, and the slots can be in other shapes, depending on specific situations. It should be noted that embodiments of the present disclosure do not specifically limit the sizes of the slots in the first ground electrode 101, the slot in the second ground electrode 105, and the slot in the third ground electrode 109. The size of the slot in the first ground electrode 101, the slot in the second ground electrode 105, and the slot in the third ground electrode 109 may be determined according to the working frequency of the coupling component 10, the thickness of each substrate, and the dielectric constant.

Figure 3:
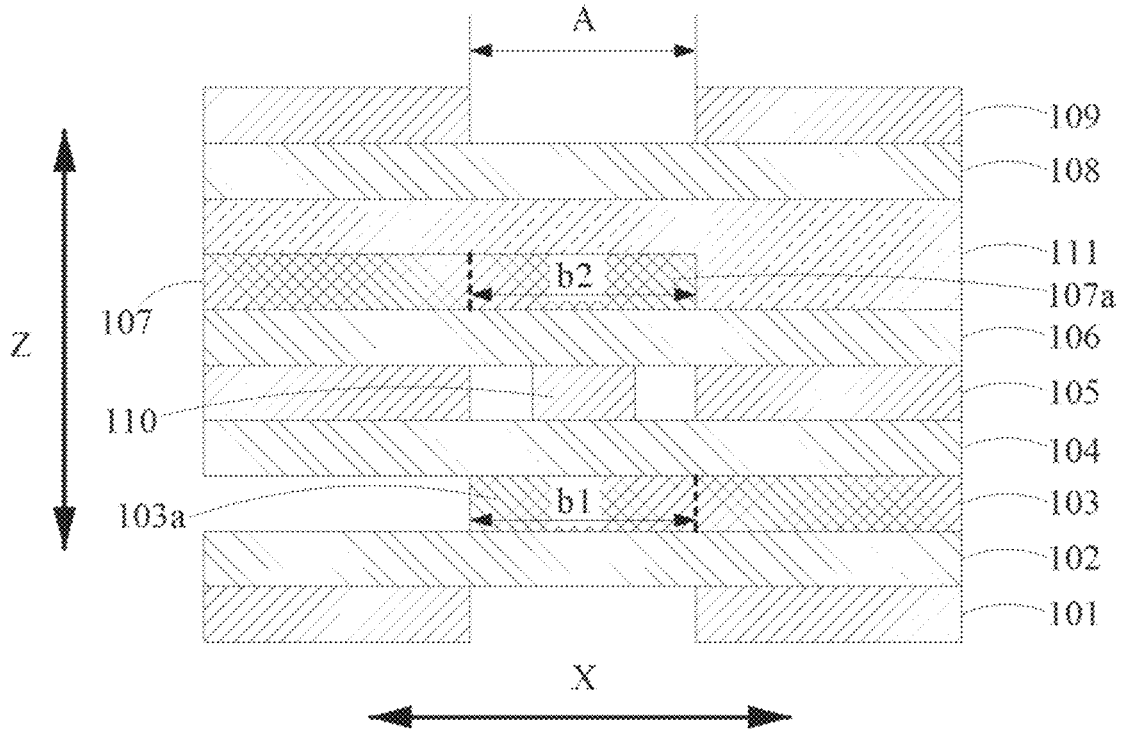
FIG. 3 is a cross-sectional view of a coupling component according to another embodiment of the present disclosure.

The distance between the first transmission line 103 and the second transmission line 107 is relatively large in the thickness direction Z, and thus the coupling efficiency of signals is relatively low when the first transmission line 103 and the second transmission line 107 are coupled, and the energy transmission loss is relatively large. To solve this problem, an embodiment of the present disclosure proposes a technical solution: a transitional transmission structure 110 is formed in the slot of the second ground electrode 105. As shown in FIG. 3, there is a gap between the transitional transmission structure 110 and the second ground electrode 105, that is, the transitional transmission line 110 is not electrically connected to the second ground electrode 105, and the transitional transmission structure 110 and the second ground electrode 105 form a coplanar waveguide. The orthographic projection of the coupling end 103*a* of the first transmission line 103 on the first dielectric layer 102 overlaps the orthographic projection of the transitional transmission structure 110 on the first dielectric layer 102; the orthographic projection of the coupling end 107*a* of the second transmission line 107 on the first dielectric layer 102 overlaps the orthographic projection of the transitional transmission structure 110 on the first dielectric layer 102.

In embodiments of the present disclosure, the transitional transmission structure 110 is introduced into the slot in the common ground electrode (i.e., the second ground electrode 105) of both the first stripline and the second stripline, so that the energy of the first transmission line 103 is first coupled to the transitional transmission structure 110 and then to the second transmission line 107; or the energy of the second transmission line 107 is first coupled to the transitional transmission structure 110 and then to the first transmission line 103. As compared with the structure in which the transitional transmission structure 110 is not introduced into the slot in the second ground electrode 105 (as shown in FIG. 1), the introduction of the transitional transmission structure 110 greatly improves the signal coupling efficiency when the first stripline and the second stripline are coupled, significantly reduces the energy transmission loss, that is, low-loss coupling between two striplines is realized.

Figure 4:
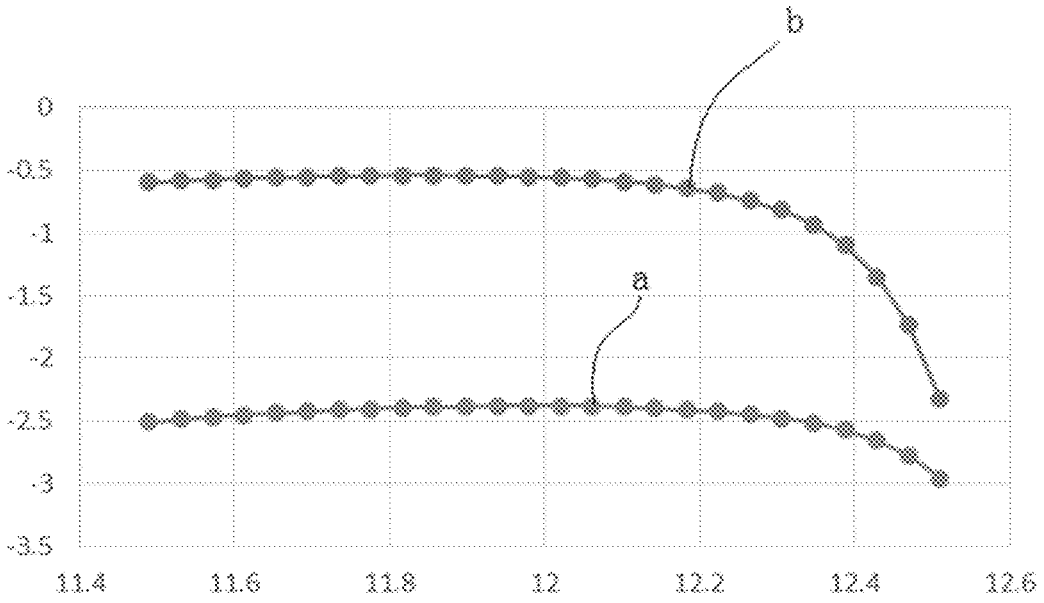
FIG. 4 is a schematic diagram showing the transmission loss of different coupling components.

Referring to FIG. 4, the abscissa in FIG. 4 is the frequency with the unit of GHz, and the ordinate is the transmission loss with the unit of dB. The line labeled a in FIG. 4 corresponds to the transmission loss at different frequencies for the coupling component in which the transitional transmission structure 110 is not introduced into the slot in the second ground electrode 105, and the line labeled b in FIG. 4 corresponds to the transmission loss at different frequencies for the structure according to some embodiments of the present disclosure in which the transitional transmission structure 110 is introduced into the slot in the second ground electrode 105. As can be seen from FIG. 4, as compared with the structure in which the transitional transmission structure 110 is not introduced into the slot in the second ground electrode 105, the structure in which the transitional transmission structure 110 is introduced into the slot in the second ground electrode 105 makes the transmission loss significantly reduced.

In an embodiment of the present disclosure, the first transmission line 103 and the second transmission line 107 both extend in the first direction X, and the first direction X and the thickness direction Z are perpendicular to each other. By making the first transmission line 103 and the second transmission line 107 extend in the first direction X, it is convenient for the signals to be transmitted in one direction. In addition, the first transmission line 103 and the second transmission line 107 both extend in the first direction X, that is, the signals are mainly transmitted in the first direction X, and in order to further reduce the transmission loss, the gap size between the transitional transmission structure 110 and the second ground electrode 105 in the first direction X needs to be designed to be relatively small. In other words, by making the first transmission line 103 and the second transmission line 107 extend in the first direction X, when designing the gap size between the transitional transmission structure 110 and the second ground electrode 105, only the gap design in one direction needs to be considered, and thus the design difficulty is reduced.

It should be understood that, as shown in FIG. 6, the two opposite sides of the transitional transmission structure 110 in the first direction X can be defined as a first side and a second side, respectively, and the two opposite sides of the transitional transmission structure 110 in a second direction Y can be defined as a third side and a fourth side respectively. The gap corresponding to the first side is defined as a first gap h1, the gap corresponding to the second side is defined as a second gap h2, the gap corresponding to the third side is defined as a third gap h3, and the gap corresponding to the fourth side is defined as a fourth gap h4. It should be noted that the second direction Y is perpendicular to the first direction X and the thickness direction Z.

Figure 7:
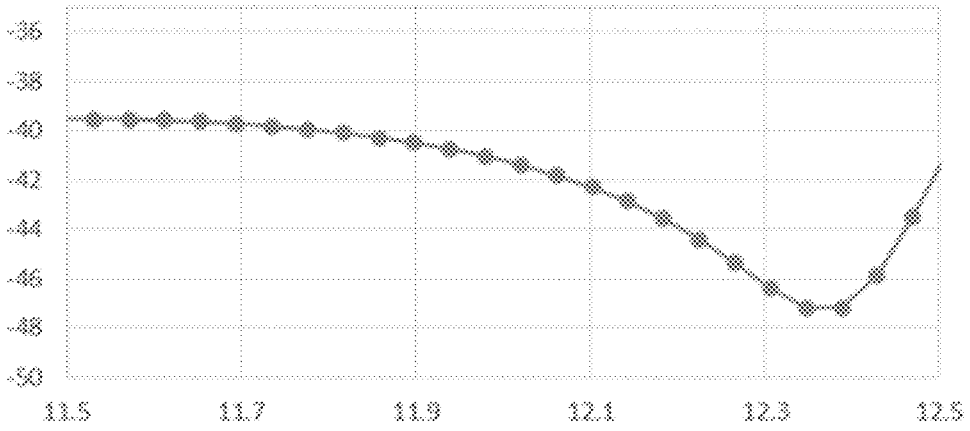
FIG. 7 is a schematic diagram showing the transmission loss when a first gap and a second gap between a transitional transmission line and a second ground electrode in the coupling component in an embodiment of the disclosure are zero.

It should be understood that the first gap h1, the second gap h2, the third gap h3, and the fourth gap h4 are all greater than 0, so that the transitional transmission structure 110 and the two opposite sides of the second ground electrode 105 in the second direction Y can constitute a coplanar waveguide, and this coplanar waveguide is specifically the part corresponding to the area B in FIG. 6. It should be noted that when the first gap h1 and the second gap h2 are 0, the transitional transmission structure 110 and the second ground electrode 105 cannot form a coplanar waveguide, and the transmission loss is very large, as shown in FIG. 7. The abscissa in FIG. 7 is the frequency with the unit of GHz, and the ordinate is the transmission loss with the unit of dB. The line shown in FIG. 7 corresponds to the transmission loss of the coupling component at different frequencies when the first slot and the second slot are zero.

In order to better reduce the transmission loss, when designing the transitional transmission structure 110 and the second ground electrode 105, although it is needed to make the first gap h1 and the second gap h2 formed between the transitional transmission structure 110 and the second ground electrode 105 greater than 0, the first gap h1 and the second gap h2 should not be too large. The smaller the first gap h1 and the second gap h2 formed between the transitional transmission structure 110 and the second ground electrode 105 are, the lower the transmission loss will be. This requires the size of the first gap h1 and the second gap h2 formed between the transitional transmission structure 110 and the second ground electrode 105 to be controlled within an appropriate range to reduce the transmission loss.

According to some embodiments, the size of the first gap h1 and the second gap h2 formed between the transitional transmission structure 110 and the second ground electrode 105 can be controlled within a range not greater than 0.1 mm. In other words, each of the gaps formed between the opposite sides of the transitional transmission structure 110 in the first direction X and the second ground electrode 105 is less than or equal to 0.1 mm. The size of each of the first gap h1 and the second gap h2 formed between the transitional transmission structure 110 and the second ground electrode 105 may be 0.025 mm, 0.05 mm, 0.075 mm, 0.1 mm, and so on, depending on the specific processing capability.

Figure 8:
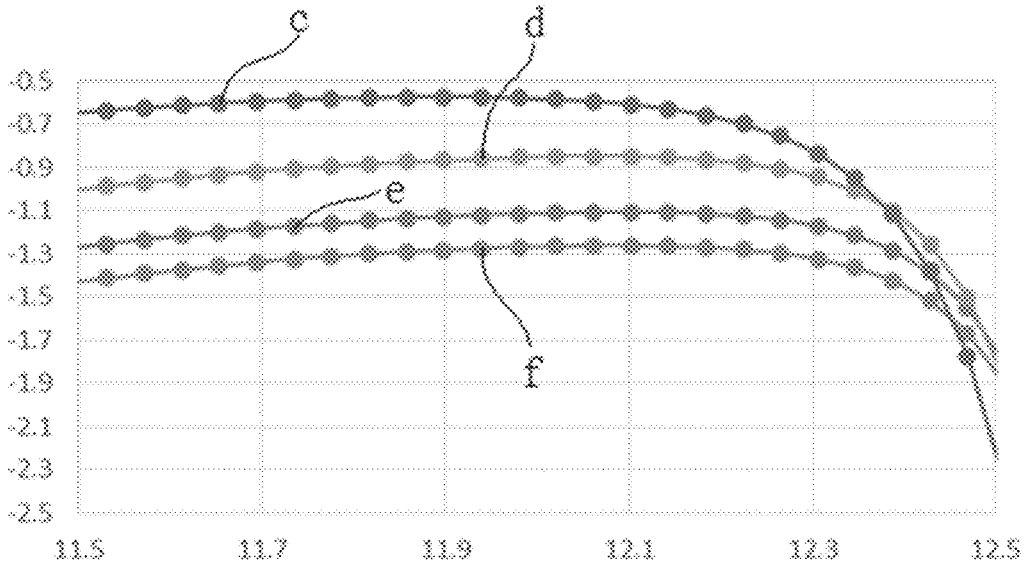
FIG. 8 is a schematic diagram showing the transmission losses when a first gap and a second gap between a transitional transmission line and a second ground electrode in different coupling components in embodiments of the disclosure are different values.

Referring to FIG. 8, the abscissa in FIG. 8 is the frequency with the unit of GHz, and the ordinate is the transmission loss with the unit of dB. The line labeled c in FIG. 8 corresponds to the transmission loss of the coupling component 10 according to embodiments of the present disclosure at different frequencies when each of the first gap h1 and the second gap h2 is 0.025 mm. The line labeled d in FIG. 8 corresponds to the transmission loss of the coupling component 10 according to embodiments of the present disclosure at different frequencies when each of the first gap h1 and the second gap h2 is 0.05 mm. The line labeled e in FIG. 8 corresponds to the transmission loss of the coupling component 10 according to embodiments of the present disclosure at different frequencies when each of the first gap h1 and the second gap h2 is 0.075 mm. The line labeled f in FIG. 8 corresponds to the transmission loss of the coupling component 10 according to embodiments of the present disclosure at different frequencies when each of the first gap h1 and the second gap h2 is 0.1 mm. As can be seen from FIG. 8, the smaller each of the first and second gaps is, the smaller the transmission loss will be. Thus, according to some embodiments of the present disclosure, in the case that the processing capability can meet the requirements, it is preferable that each of the first gap h1 and the second h2 is not larger than 0.1 mm.

It should be noted that the sizes of the third gap h3 and the fourth gap h4 depend on the transmission impedance of the coplanar waveguide design and the thickness and dielectric constant of the upper and lower dielectric plates (i.e., the second dielectric layer and the first substrate).

The gaps formed between the two opposite sides of the transitional transmission structure 110 in the first direction X and the second ground electrode 105 are equal; that is, the size of the first gap h1 and the size of the second gap h2 can be equal. The gaps formed between the two opposite sides of the transitional transmission structure 110 in the second direction Y and the second ground electrode 105 are equal; that is, the size of the third gap h3 and the size of the fourth gap h4 can be equal. However, embodiments of the present disclosure are not limited to this. For example, the size of the first gap h1 and the size of the second gap h2 may be unequal, and the size of the third gap h3 and the size of the fourth gap h4 may be unequal, depending on design requirements. When describing some embodiments, the situation in which the first gap h1 and the second gap h2 have the equal size and the third gap h3 and the fourth gap h4 have the equal size is taken as an example.

In some embodiments, the shape of the transitional transmission structure 110 can be circular or rectangular. Specifically, the shape of the transitional transmission structure 110 can match the shape of the slot in the second ground electrode 105. That is, when the shape of the slot in the second ground electrode 105 is circular, the shape of the transitional transmission structure 110 is circular. When the shape of the slot in the second ground electrode 105 is rectangular, the shape of the transitional transmission structure 110 is rectangular. This is convenient for adjusting the sizes of the gaps between the transitional transmission structure 110 and the second ground electrode 105 to make the structure meet the process requirements.

According to some embodiments, the width b1 of the coupling end 103*a* of the first transmission line 103 can be the same as the width of the slot in the second ground electrode 105, and the width b2 of the coupling end 107*a* of the second transmission line 107 can be the same as the width of the slot in the second ground electrode 105. It should be noted that the width mentioned here refers to the size in the first direction X.

Further, the orthographic projection of the coupling end 103*a* of the first transmission line 103 on the first dielectric layer 102 and the orthographic projection of the slot in the second ground electrode 105 on the first dielectric layer 102 completely overlap in the first direction X. That is, the orthographic projection of the coupling end 103*a* of the first transmission line 103 on the first dielectric layer 102 is the first orthographic projection, the orthographic projection of the slot of the second ground electrode 105 on the first dielectric layer 102 is the second orthographic projection, and two opposite boundaries of the first orthographic projection in the first direction X overlap with two opposite boundaries of the second orthographic projection in the first direction X, respectively. The orthographic projection of the coupling end 107*a* of the second transmission line 107 on the first dielectric layer 102 and the orthographic projection of the slot of the second ground electrode 105 on the first dielectric layer 102 completely overlap in the first direction X. That is, That is, the orthographic projection of the coupling end 107*a* of the second transmission line 107 on the first dielectric layer 102 is the third orthographic projection, the orthographic projection of the slot of the second ground electrode 105 on the first dielectric layer 102 is the second orthographic projection, and two opposite boundaries of the third orthographic projection in the first direction X overlap with two opposite boundaries of the second orthographic projection in the first direction X, respectively. This design can ensure that the coupling areas between the first transmission line 103, the transitional transmission structure 110, and the second transmission line 107 are large enough to improve coupling efficiency and reduce transmission loss.

Further, ends of the first transmission line 103 and the second transmission line 107 opposite to the coupling ends in the first direction X can be defined as extension ends. The extension end of the first transmission line 103 and the extension end of the second transmission line 107 extend away from each other, so as to better realize the coupling between the first transmission line 103 and the second transmission line 107 during the manufacturing process.

In an embodiment of the present disclosure, as shown in FIGS. 1 and 3, the coupling component 10 may further include a liquid crystal layer 111. At least part of the liquid crystal layer 111 may be located between the second transmission line 107 and the second substrate 108. When a microwave signal is transmitted in the liquid crystal layer 111, by adjusting the voltages on both sides of the liquid crystal layer 111, the liquid crystal molecules can be deflected, so that the dielectric constant of the liquid crystal layer 111 will be changed accordingly, and the phase of the microwave signal can be adjusted.

For example, the first transmission line 103 can be connected to a power feeder to obtain energy, and then the first transmission line 103 can transmit the energy to the transitional transmission structure 110 through its coupling end 103*a*, and then the energy is transmitted to the coupling end 107*a* of the second transmission line 107 through the transitional transmission structure 110. That is, the second transmission line 107 obtains the energy, and the liquid crystal layer 111 can be deflected under the action of the second transmission line 107 and the third ground electrode 109 to adjust the phase of the microwave signal. It should be noted that the first transmission line 103 can also obtain energy by coupling with its transmission structure.

The first dielectric layer 102 and the second dielectric layer 104 may be printed circuit substrates, that is, PCB substrates. The first substrate 106 and the second substrate 108 may be glass substrates. However, embodiments of the present disclosure are not limited to this. For example, depending on the application scenarios of the coupling component 10, the first dielectric layer 102, the second dielectric layer 104, the first substrate 106, and the second substrate 108 may all be glass substrates, or the first dielectric layer 102, the second dielectric layer 104, the first substrate 106, and the second substrate 108 may all be PCB substrates, and so on. According to some other embodiments, the coupling component 10 may not include the liquid crystal layer 111, and the position of the liquid crystal layer 111 may be replaced with a dielectric substrate, depending on actual requirements.

In embodiments of the present disclosure, by setting the transitional transmission structure 110, the coupling of transmission lines in different layers is realized, and the coupling efficiency of signals when the transmission lines in different layers are coupled is improved and the transmission loss of energy is significantly reduced. Therefore, it is not required to form holes in the first dielectric layer 102, the second dielectric layer 104, the first substrate 106, and the second substrate 108, thereby reducing the cost of the coupling component 10 and increasing the product yield.

In an embodiment of the present disclosure, a microwave device is provided, and the microwave device may include the coupling component 10 described in any of the foregoing embodiments.

Optionally, the microwave device may be a phase shifter, an antenna or a filter, but the present disclosure is not limited thereto.

In an embodiment of the present disclosure, there is also provided an electronic device, and the electronic device includes the aforementioned microwave device.

Optionally, the electronic device may be a transmitter, a receiver, an antenna system, or a display, but the present disclosure is not limited thereto.

Those skilled in the art will easily think of other embodiments after considering the specification and practicing the contents disclosed herein. The present disclosure is intended to cover any variations, uses, or adaptive changes of the present disclosure, and these variations, uses, or adaptive changes follow the general principles of the present disclosure and include common knowledge or conventional technical means in the technical field that are not disclosed in the present disclosure. The description and embodiments are only regarded as exemplary, and the scope of the present disclosure is defined by the appended claims.

What is claimed is:

1. A coupling component, comprising a first ground electrode, a first dielectric layer, a first transmission line, a second dielectric layer, a second ground electrode, a first substrate, a second transmission line, a second substrate and a third ground electrode which are sequentially stacked;

wherein:

each of the first ground electrode, the second ground electrode, and the third ground electrode has a slot, and orthographic projections of the slots of the first ground electrode, the second ground electrode and the third ground electrode on the first dielectric layer overlap;

an orthographic projection of a coupling end of the first transmission line on the first dielectric layer overlaps an orthographic projection of the slot of the second ground electrode on the first dielectric layer; and an orthographic projection of a coupling end of the second transmission line on the first dielectric layer overlaps the orthographic projection of the slot of the second ground electrode on the first dielectric layer.

2. The coupling component according to claim 1, wherein a transitional transmission structure is provided in the slot of the second ground electrode, and a gap is provided between the transitional transmission structure and the second ground electrode.

3. The coupling component according to claim 2, wherein:

the orthographic projection of the coupling end of the first transmission line on the first dielectric layer overlaps an orthographic projection of the transitional transmission structure on the first dielectric layer; and the orthographic projection of the coupling end of the second transmission line on the first dielectric layer overlaps the orthographic projection of the transitional transmission structure on the first dielectric layer.

4. The coupling component according to claim 1, wherein both the first transmission line and the second transmission line extend in a first direction.

5. The coupling component according to claim 4, wherein each of gaps formed between two opposite sides of the transitional transmission structure in the first direction and the second ground electrode is not greater than 0.1 mm.

6. The coupling component according to claim 4, wherein:

the orthographic projection of the coupling end of the first transmission line on the first dielectric layer completely overlaps the orthographic projection of the slot of the second ground electrode on the first dielectric layer in the first direction; and the orthographic projection of the coupling end of the second transmission line on the first dielectric layer completely overlaps the orthographic projection of the slot of the second ground electrode on the first dielectric layer in the first direction.

7. The coupling component according to claim 1, wherein the orthographic projections of the slot of the first ground electrode, the slot of the second ground electrode, and the slot of the third ground electrode on the first dielectric layer completely overlap.

8. The coupling component according to claim 1, wherein the slot of the first ground electrode, the slot of the second ground electrode, the slot of the third ground electrode, and the transitional transmission structure have a same shape.

9. The coupling component according to claim 1, wherein the coupling component further comprises a liquid crystal layer, and at least a part of the liquid crystal layer is located between the second transmission line and the second substrate.

10. The coupling component according to claim 9, wherein:

the first dielectric layer and the second dielectric layer are printed circuit substrates; and the first substrate and the second substrate are glass substrates.

11. The coupling component according to claim 1, wherein each of the first dielectric layer, the second dielectric layer, the first substrate, and the second substrate has a thickness of 0.1 mm to 10 mm.

12. The coupling component according to claim 1, wherein each of the first ground electrode, the second ground electrode, and the third ground electrode has a thickness of 0.1 μm to 100 μm.

13. A microwave device, comprising a coupling component;

wherein:

the coupling component comprises a first ground electrode, a first dielectric layer, a first transmission line, a second dielectric layer, a second ground electrode, a first substrate, a second transmission line, a second substrate and a third ground electrode which are sequentially stacked;

each of the first ground electrode, the second ground electrode, and the third ground electrode has a slot, and orthographic projections of the slots of the first ground electrode, the second ground electrode and the third ground electrode on the first dielectric layer overlap;

an orthographic projection of a coupling end of the first transmission line on the first dielectric layer overlaps an orthographic projection of the slot of the second ground electrode on the first dielectric layer; and an orthographic projection of a coupling end of the second transmission line on the first dielectric layer overlaps the orthographic projection of the slot of the second ground electrode on the first dielectric layer.

14. The microwave device according to claim 13, wherein the microwave device is a phase shifter, an antenna or a filter.

15. An electronic device, comprising a microwave device which comprises a coupling component;

wherein:

the coupling component comprises a first ground electrode, a first dielectric layer, a first transmission line, a second dielectric layer, a second ground electrode, a first substrate, a second transmission line, a second substrate and a third ground electrode which are sequentially stacked;

each of the first ground electrode, the second ground electrode, and the third ground electrode has a slot, and orthographic projections of the slots of the first ground electrode, the second ground electrode and the third ground electrode on the first dielectric layer overlap;

an orthographic projection of a coupling end of the first transmission line on the first dielectric layer overlaps an orthographic projection of the slot of the second ground electrode on the first dielectric layer; and an orthographic projection of a coupling end of the second transmission line on the first dielectric layer overlaps the orthographic projection of the slot of the second ground electrode on the first dielectric layer.

16. The electronic device according to claim 15, wherein the electronic device is a transmitter, a receiver, an antenna system, or a display.

17. The microwave device according to claim 13, wherein a transitional transmission structure is provided in the slot of the second ground electrode, and a gap is provided between the transitional transmission structure and the second ground electrode.

18. The microwave device according to claim 17, wherein:

the orthographic projection of the coupling end of the first transmission line on the first dielectric layer overlaps an orthographic projection of the transitional transmission structure on the first dielectric layer; and the orthographic projection of the coupling end of the second transmission line on the first dielectric layer overlaps the orthographic projection of the transitional transmission structure on the first dielectric layer.

19. The microwave device according to claim 13, wherein both the first transmission line and the second transmission line extend in a first direction.

20. The microwave device according to claim 19, wherein each of gaps formed between two opposite sides of the transitional transmission structure in the first direction and the second ground electrode is not greater than 0.1 mm.

* * * * *